US005416378A

United States Patent [19]

Andrevski

[11] Patent Number: 5,416,378

[45] Date of Patent: May 16, 1995

[54] COLOR PICTURE TUBE WITH IRON-NICKEL ALLOY SHADOW MASK

[75] Inventor: Zygmunt M. Andrevski, Princeton, N.J.

[73] Assignee: RCA Thomson Licensing Corporation, Princeton, N.J.

[21] Appl. No.: 145,125

[22] Filed: Nov. 3, 1993

[51] Int. Cl.[6] ..... H01J 29/07

[52] U.S. Cl. ..... 313/402; 313/407; 313/408; 445/36; 445/37

[58] Field of Search ..... 313/402, 403, 404, 405, 313/406, 407, 408; 445/36, 37

[56] References Cited

U.S. PATENT DOCUMENTS

| | | | |
|---|---|---|---|
| 3,404,302 | 10/1968 | Nicklas | 313/402 |
| 3,912,963 | 10/1975 | Sedivy | 313/402 |
| 4,056,755 | 11/1977 | Sohn | 313/402 |
| 4,536,226 | 8/1985 | Ohtake et al. | 148/12 C |
| 4,754,188 | 6/1988 | Watanabe et al. | 313/402 |
| 4,801,842 | 1/1989 | Compen | 313/402 |
| 4,890,471 | 1/1990 | Ito | 72/348 |
| 5,005,396 | 4/1991 | DeSmet | 72/309 |

FOREIGN PATENT DOCUMENTS

| | | | |
|---|---|---|---|
| 1084097 | 8/1980 | Canada | 313/402 |

*Primary Examiner*—Donald J. Yusko
*Assistant Examiner*—N. D. Patel
*Attorney, Agent, or Firm*—Joseph S. Tripoli; Dennis H. Irlbeck

[57] ABSTRACT

The present invention provides an improved color picture tube having a viewing screen and a shadow mask mounted adjacent to the screen. The mask has an apertured contoured portion and a peripheral skirt. The improvement comprises the skirt having a reverse bend therein, wherein a first portion of the skirt that connects with the apertured contoured portion extends away from the screen and a second portion of the skirt more remote from the apertured contoured portion extends towards the screen.

3 Claims, 5 Drawing Sheets

COLOR PICTURE TUBE WITH IRON-NICKEL ALLOY SHADOW MASK

This invention relates to color picture tubes having shadow masks therein, and particularly to such tubes having shadow masks made from materials having low coefficients of thermal expansion, such as iron-nickel alloys.

BACKGROUND OF THE INVENTION

A color picture tube includes an electron gun for forming and directing three electron beams to a screen of the tube. The screen is located on the inner surface of a faceplate of the tube and comprises an array of elements of three different color emitting phosphors. An apertured mask, called a shadow mask, is interposed between the gun and the screen to permit each electron beam to strike only the phosphor elements associated with that beam.

The shadow mask is a thin sheet of metal, such as AK steel or an iron-nickel alloy, that is contoured to somewhat parallel the inner surface of the tube faceplate. The shadow mask includes a large central apertured portion, a solid border portion surrounding the apertured portion, and a peripheral skirt portion. The skirt portion is angled from the other portions of the mask and is usually welded to a peripheral frame that supports the mask within a faceplate panel of a tube.

To make the shadow mask, a flat sheet of metal is etched to form the apertures, which are usually elongated slots or circular holes. Thereafter, the sheet is formed into the desired contour, such as spherical or biradial, and a skirt is formed by sweeping back the peripheral edge of the sheet. When a mask is cold-formed out of AK steel, a certain amount of springback occurs in the apertured portion of the mask, and the skirt flares slightly outwardly. For a 27 V tube, this skirt flare can be about 4.5°. When an iron-nickel alloy, such as Invar (36% nickel-TM Reg. #63,970), is cold-formed into a mask contour, the springback and skirt flare are considerably greater than they are in the same size AK steel mask. For a 27 V tube with an Invar mask, the skirt flare is about 18.8°. The springback and skirt flare in Invar masks are caused by the residual stresses that are created in the masks when they are formed into their contours. In the prior art, these residual stresses are at least partially controlled by hot-forming, instead of cold-forming, the masks. One hot-forming method is described in U.S. Pat. No. 4,536,226, issued to Ohtake et al. on Aug. 20, 1985. In the method disclosed in that patent, a fiat mask is first annealed at a temperature in the range of 1173° K. to 1473° K. Then, the mask is pressed into a domed contour at a temperature in the range of 298° K. to 473° K. This hot-forming method is expensive, because of the heating involved. Also, it has been found that small deviations in temperature across a mask, during pressing, can create random variations in the stresses across the mask, which result in unpredictable springback. Because of these disadvantages of hot-forming, there is a need to develop iron-nickel masks that can be cold-formed accurately with acceptable springback and skirt flare.

SUMMARY OF THE INVENTION

The present invention provides an improved color picture tube having a viewing screen and a shadow mask mounted adjacent to the screen. The mask has an apertured contoured portion and a peripheral skirt. The improvement comprises the skirt having a reverse bend therein, wherein a first portion of the skirt that connects with the apertured contoured portion extends away from the screen, and a second portion of the skirt more remote from the apertured contoured portion extends towards the screen.

DETAILED DESCRIPTION OF THE PREFERRED EMBODIMENTS

Figure 1:
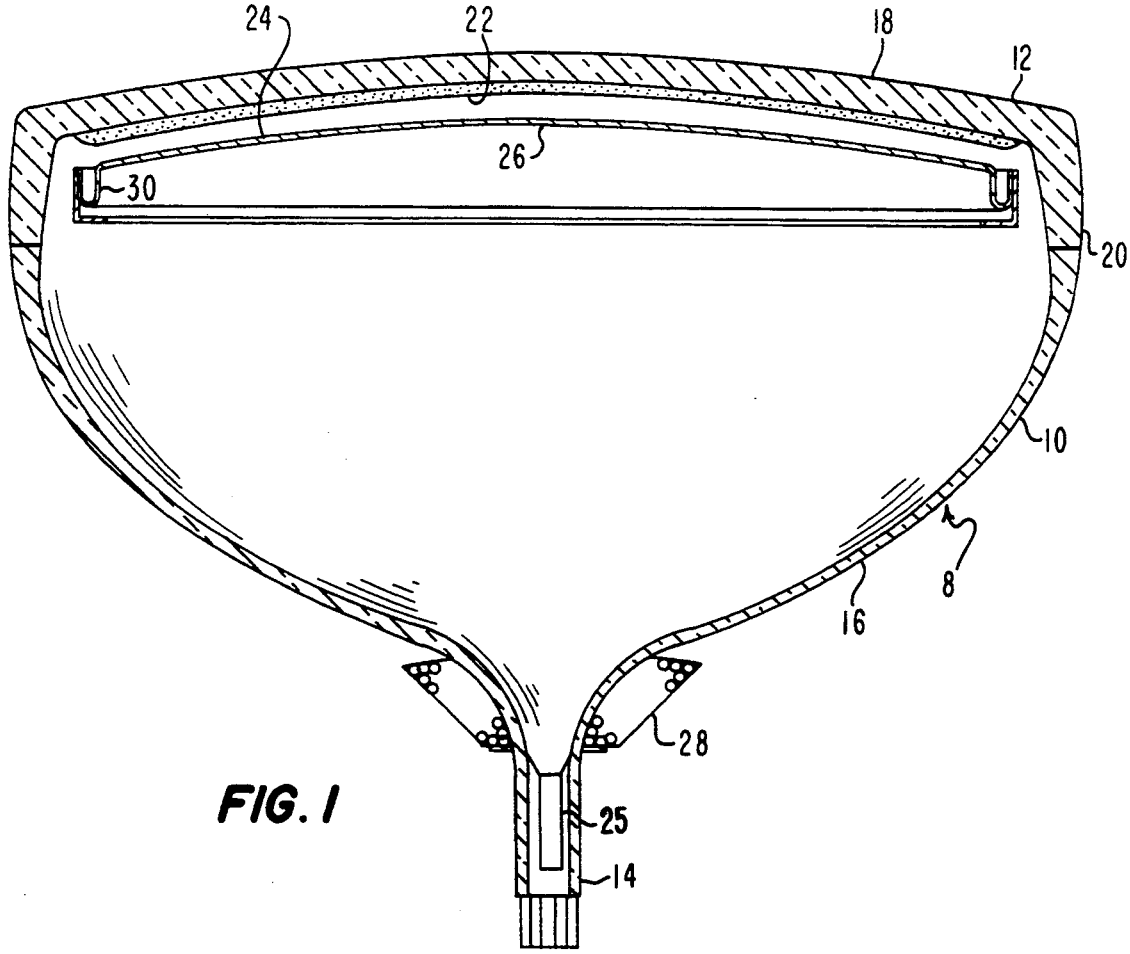
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. A mosaic three-color phosphor screen 22 is located on the inner surface of the faceplate 18. The screen preferably is a line screen, with vertically extending parallel phosphor lines. Alternatively, the screen may be a dot screen. A multiapertured color selection electrode or shadow mask 24 is removably mounted in predetermined spaced relation to the screen 22. An electron gun 25 is centrally mounted within the neck 14, to generate and direct three electron beams along convergent paths through the mask 24 to the screen 22.

The tube of FIG. 1 is designed to be used with an external magnetic deflection yoke 28 located in the vicinity of the funnel-to-neck junction. When activated, the yoke 28 subjects the three electron beams to magnetic fields which cause the beams to scan horizontally and vertically in a rectangular raster over the screen 22.

Figure 2:
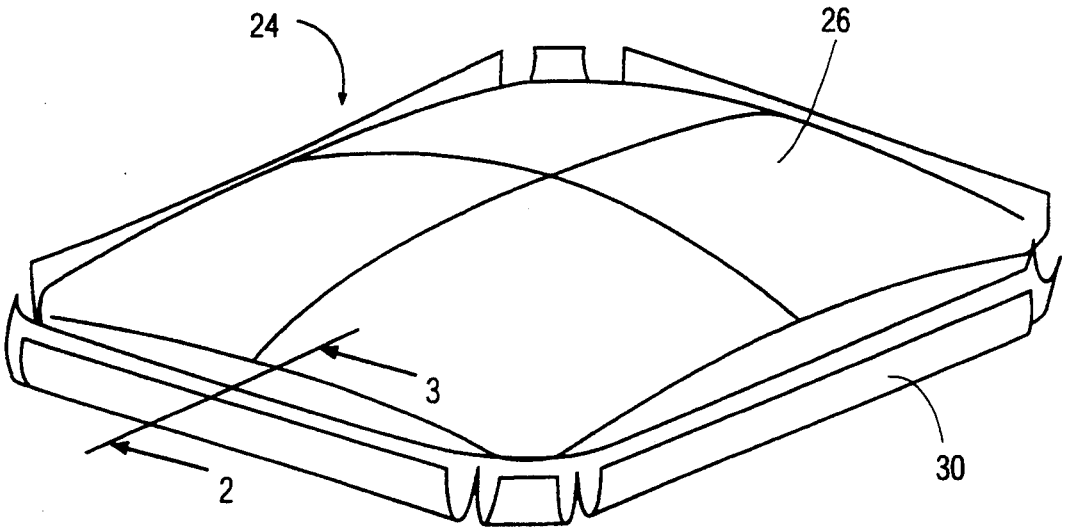
FIG. 2 is a perspective view of a shadow mask of the tube of FIG. 1.
Figure 3:
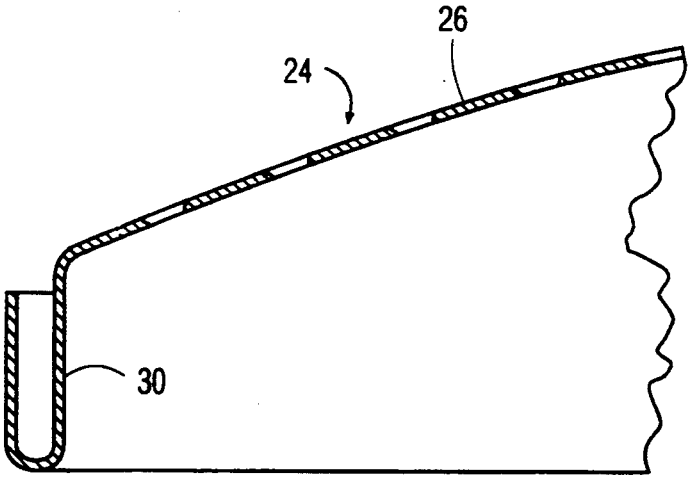
FIG. 3 is a cross-sectional view of the mask of FIG. 1 token at lines 3—3.

The shadow mask 24, also shown in FIGS. 2 and 3, includes an apertured contoured portion 26 and a peripheral skirt 30 surrounding the apertured contoured portion 26. The shadow mask is mounted within a peripheral frame 32 that is mounted in the faceplate panel 12 either by support means (not shown) positioned at the four comers of the shadow mask or by support means (not shown) located along the sides of the mask.

A novel aspect of the shadow mask 24 is the cross-sectional shape of its skirt 30. The skirt 30 has a reverse curvature, or reverse bend, such that the skirt has a U-shaped cross-section. This reverse bend reduces the stresses in a cold-formed iron-nickel mask by approximately 50% and "locks" the stresses so that they will not subsequently change. The design of the mask 24 is discussed below.

Figure 4:
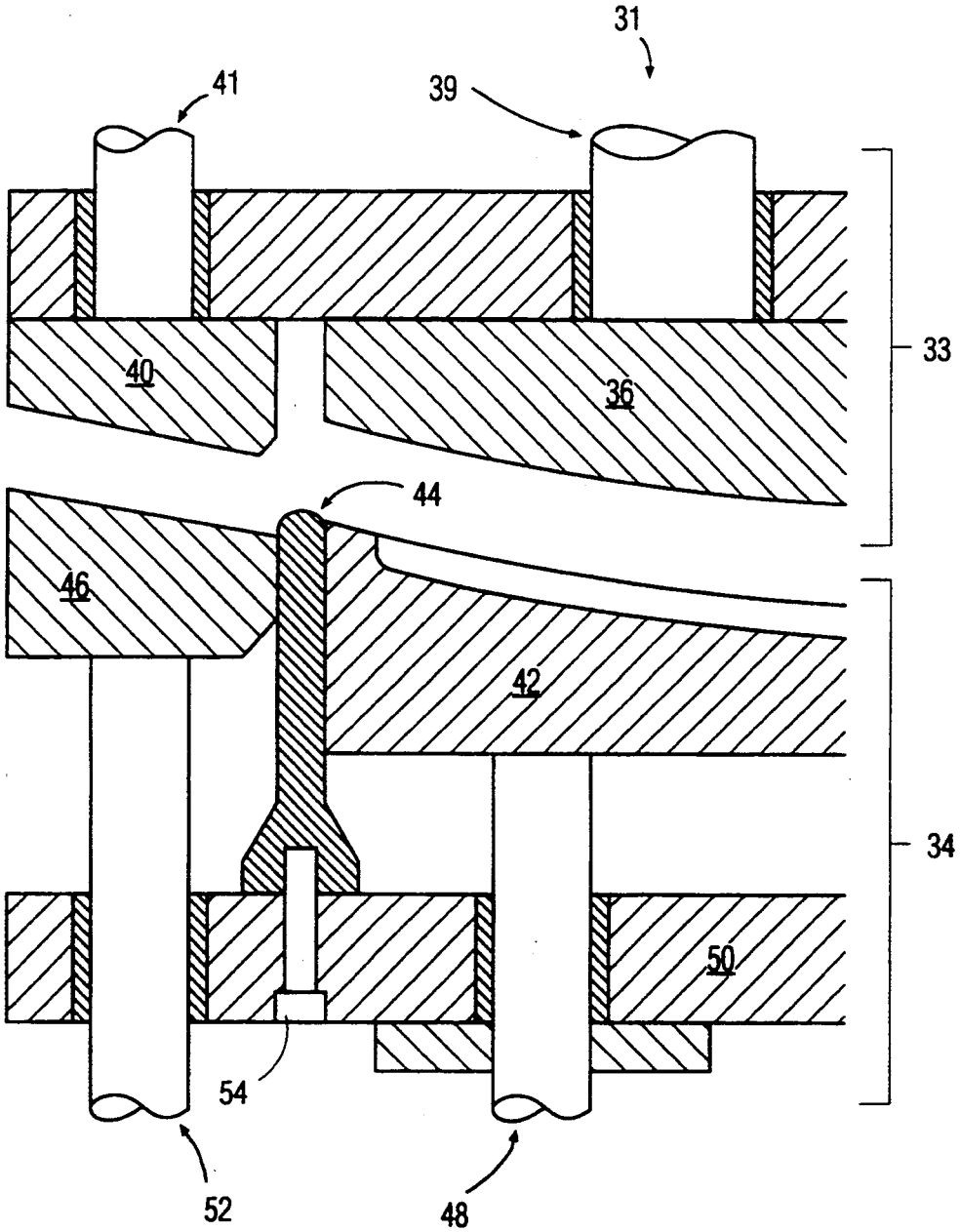
FIG. 4 is a cross-sectional partial view of a mask press.

The mask is formed on a shadow mask press 31, as shown in FIG. 4. There are two major parts of the shadow mask press 31, the upper punch assembly 33 and the lower die assembly 34. The upper punch assembly 33 includes a punch 36 having a bottom surface which is shaped in contour similarly to the desired shadow mask shape. There is some difference in contour between the punch 36 and desired mask shape, to allow for material spring-back after the mask is formed. The punch 36 is attached to an upper plate 38 that is in turn connected to the remainder of the press, not shown, by hydraulic pistons 39 (only one of which is shown). A slidably mounted pressure or wipe ring 40 surrounds the punch 36 and is in sliding contact with a side thereof. The position of the wipe ring 40 is controlled by separate hydraulic pistons 41 (only one of which is shown).

The lower die assembly 34 includes a knockout pad 42, a reverse bend ring 44 that surrounds the knockout pad, and a peripheral die 46 that surrounds the reverse bend ring 44. The knockout pad 42 is attached to hydraulic pistons 48 (only one of which is shown) that extend through apertures in a die set plate 50 that is positioned below the knockout pad 42. The peripheral die 46 is attached to another set of hydraulic pistons 52 (only one of which is shown) that also extend through apertures in the die set plate 50. The reverse bend ring 44 is attached directly to the die set plate 50 by bolts 54.

Figure 5:
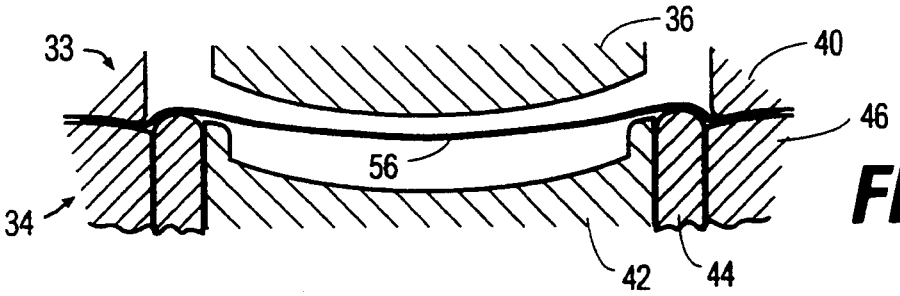
FIGS. 5 through 9 are cross-sectional views of a mask press, showing five different steps that occur during the formation of the mask of FIG. 2.
Figure 6:
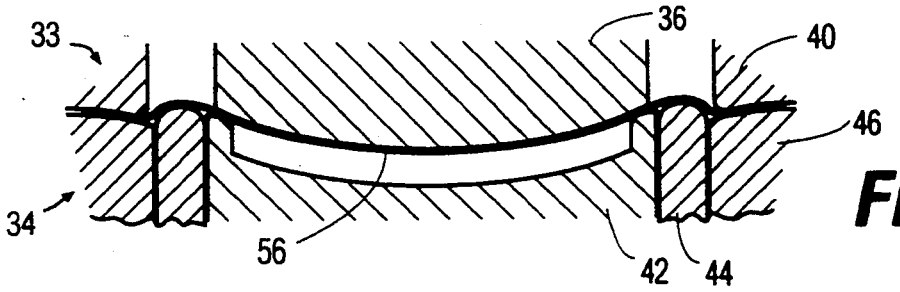
Figure 7:
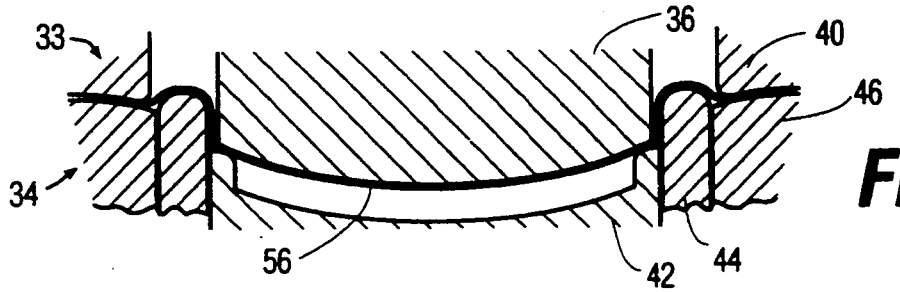
Figure 8:
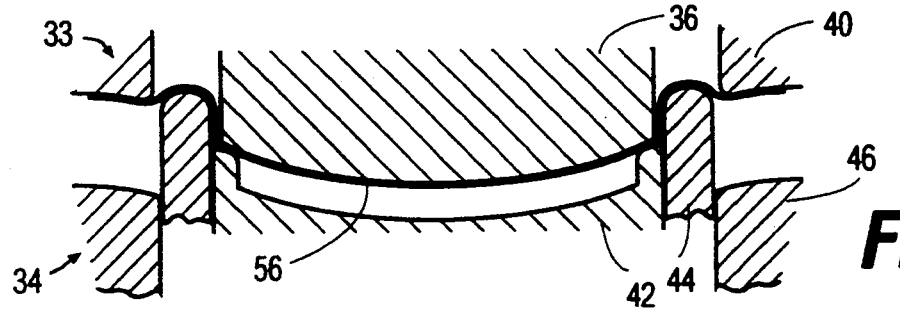
Figure 9:
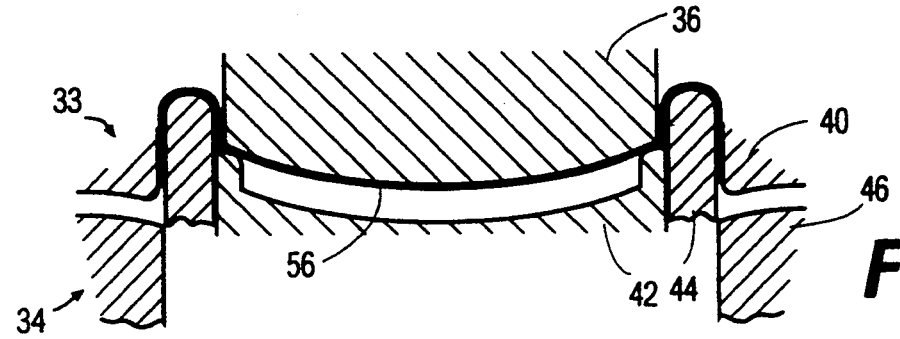

The upper punch assembly 33 and lower die assembly 34 are first spaced apart and a flat shadow mask 56 is placed there between. Then, the pistons 41 are activated, to clamp the mask 56 between the wipe ring 40 and the die 46, as shown in FIG. 5. Next, the pistons 39 are activated and the punch 36 is lowered until it presses the mask 56 against the knockout pad 42, thereby doming the mask 56, as shown in FIG. 6. The punch 36 continues downward, pressing against the knockout pad 42, until a skirt portion of the mask 56 is approximately half wiped against the reverse bend ring 44, as shown in FIG. 7. Next, the pistons 52 are activated and the die 46 is lowered, thereby releasing the edges of the mask 56, as shown in FIG. 8. Finally, the pistons 41 are activated to lower the wipe ring 40, causing it to wipe the end skirt portion of the mask against the reverse bend ring 44, and thus form the reverse bend in the mask, as shown in FIG. 9.

Figure 10:
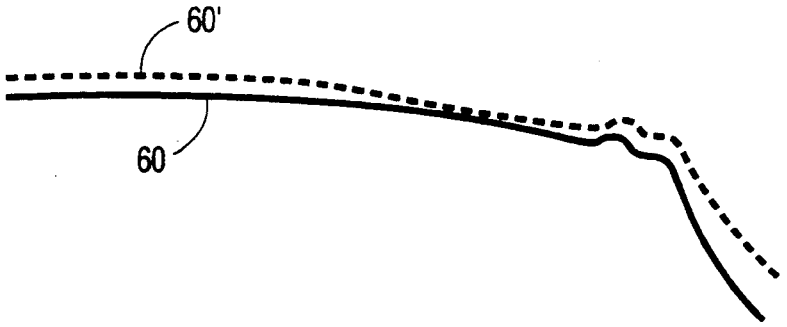
FIGS. 10 and 11 are cross-section profiles of a cold-formed shadow mask cut along its major axis and along its minor axis, respectfully.
Figure 11:
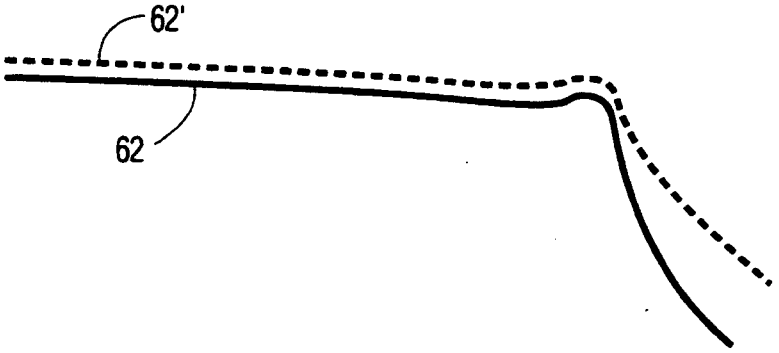

The design of placing a reverse bend in the skirt of an iron-nickel shadow mask was the result of an extensive study of mask forming that was conducted in order to find a method of cold-forming iron-nickel shadow masks. The study included work on both AK steel masks and iron-nickel masks, so that comparisons could be made. During the study, Invar shadow masks first were cold-formed using the same pressing techniques that were previously used for AK steel masks. The solid lines 60 and 62 in FIGS. 10 and 11, respectively, represent the cross-sections of an Invar shadow mask after it had been cold-formed. FIG. 10 shows a contour along the major axis of the mask, and FIG. 11 shows a contour along the minor axis of the mask. The dashed lines 60′ and 62′ in FIGS. 10 and 11, respectfully, represent the same mask after removal of two small sections of the mask skirt in each of the four corners of the mask. In both FIGS. 10 and 11, it can be seen that cutting the mask corners causes the mask skirt to spring out and a portion of the domed part of the mask to have a reverse curvature. The spring out and reverse curvature indicate that the mask was originally under considerable stress that was balanced by tension in the mask skirt, before the skirt was cut in the mask corners.

In other studies, tests were made to determine the nature of the stresses in Invar masks and where the stresses were formed during the cold-forming process. In such tests, the mask contours and skirt shapes were checked after each stage of mask forming. When an Invar mask was only clamped, such as between the wipe ting and die, as shown in FIG. 5, it was noted that the formed curvature in the Invar mask was only 40% that of an AK steel mask, and that the apertured portion of the Invar mask exhibited an irregular shape with concave surfaces on both sides along the major axis. Furthermore, the ends of the skirt sections along the major axis of the Invar mask were bent outwardly. When the Invar mask was pressed into a dome-shape, as shown in FIG. 6, it was noted that the clamped skirt surface curvature approximated 80% of that of the AK steel mask in the skirt areas. The dome surface was also flatter than the AK steel mask and had some visible waviness in the corners of the domed surface. However, when the mask skirt was half wiped, as in FIG. 7, a surprising result occurred. The half wipe eliminated all previous differences in appearance between the Invar and AK steel masks. The formed contours of the Invar mask and the AK steel mask were nearly identical. Apparently, with the half wiped skirt, the Invar mask was rigid enough to overcome the springback of the domed surface of the mask. When the forming was continued to complete the forming of the skirt, it appeared that the stresses that were locked up during the half wipe were released and a relatively drastic amount of springback occurred.

Studies, such as described above, indicated that iron-nickel alloy or Invar masks can be cold-formed into useful masks, if the mask skirt is half-wiped during forming and the tensions in the skirt are somehow locked. In an embodiment of the present invention, the compressive stress in the half-wiped portion of the skirt is locked by reverse bending the outer portion of the skirt, so that the skirt has a U-shape. The final shape of the skirt puts the outer portion of the skirt into a tension which eliminates any wrinkles at the edge of the skirt, thus making the skirt edge straight.

What is claimed is;

1. In a color picture tube having a viewing screen and a shadow mask mounted within a peripheral frame adjacent to said screen, said mask having an apertured contoured portion and a peripheral skirt surrounding said apertured contoured portion, wherein said shadow mask is made of an iron-nickel alloy material that has been cold-formed, the improvement comprising said mask skirt having a bend in two directions therein, wherein a first portion of said skirt that connects with said apertured contoured portion extends away from said screen and a remaining portion of said skirt extends toward said screen, said skirt having a cross-sectional U-shape with the open end of the U-shape facing said screen, wherein the first portion of said skirt forms approximately half of said U-shape and the remaining portion of said skirt forms the other half of said U-shape, and a bend between said remaining and first portion of said skirt locking in stresses in said first portion of said skirt that were formed during the cold-forming of said mask.

2. A method of cold-forming a shadow mask for use in a color picture tube from a flat shadow mask of an iron-nickel alloy material, said flat shadow mask including an apertured portion and a peripheral skirt, comprising the steps of:

a) clamping said skirt, b) doming said apertured portion into a contoured shape, c) half wiping a first portion of said skirt in a first direction, d) releasing said clamped skirt, and e) wiping a second portion of said skirt in a second direction that is opposite to said first direction, whereby stresses existing in said half wiped first portion of said skirt are locked by a bend in said skirt formed between said first and second portions of said skirt.

3. A method of cold-forming a shadow mask for use in a color picture tube from a flat shadow mask of an iron-nickel alloy material, said flat shadow mask including an apertured portion and a peripheral skirt, comprising the steps of:

a) clamping said skirt, b) doming said apertured portion into a contoured shape, c) bending a first portion of said skirt in a first direction, d) releasing said clamped skirt, and e) bending a second portion of said skirt in a second direction that is opposite to said first direction, whereby stresses existing in said first portion of said skirt are locked by a bend in said skirt formed between said first and second portions of said skirt.

* * * * *